United States Patent [19]

Rozek

[11] Patent Number: 4,848,743

[45] Date of Patent: Jul. 18, 1989

[54] POPPING SOUND TOY

[76] Inventor: Peter J. Rozek, 1903 W. Mallory Ave., Milwaukee, Wis. 53221

[21] Appl. No.: 129,298

[22] Filed: Dec. 7, 1987

[51] Int. Cl.[4] ..... A63B 67/00

[52] U.S. Cl. ..... 273/1 A; 273/1 GA; 446/181

[58] Field of Search ..... 273/1 R, 1 A, 1 G, 1 GA; 446/176, 181, 404, 188

[56] References Cited

U.S. PATENT DOCUMENTS

| | | | |
|---|---|---|---|
| 2,174,716 | 10/1939 | Bethell | 272/56.5 |
| 2,247,635 | 7/1941 | Illers | 273/380 |
| 3,634,895 | 1/1972 | Childers | 5/345 |
| 3,927,880 | 12/1975 | Petrusek | 273/1 A |
| 4,155,552 | 5/1979 | Jacobo et al. | 273/380 |
| 4,181,548 | 1/1980 | Weingarten | 156/145 |
| 4,378,391 | 3/1983 | Allen | 446/181 X |
| 4,472,472 | 9/1984 | Schultz | 428/178 |
| 4,559,015 | 12/1985 | Felesky | 273/1 GA |

FOREIGN PATENT DOCUMENTS

| | | | |
|---|---|---|---|
| 339449 | 12/1930 | United Kingdom | 273/153 R |

*Primary Examiner*—Anton O. Oechsle
*Attorney, Agent, or Firm*—Quarles & Brady

[57] ABSTRACT

A game or amusement device adapted to making a popping sound when compressed in certain areas. A series of bubble like pocket members are constructed so that when they are compressed by at least a child's body weight they will break and make a popping sound. The series of bubble like pocket members are arranged in a manner that they can be supported on a supporting surface and indicia placed are over said pocket members to indicate to a player a predetermined pattern for breaking the pocket members. In one embodiment the indicia comprises markings which delineate a roadway composed of obstacles with directional arrows.

7 Claims, 3 Drawing Sheets

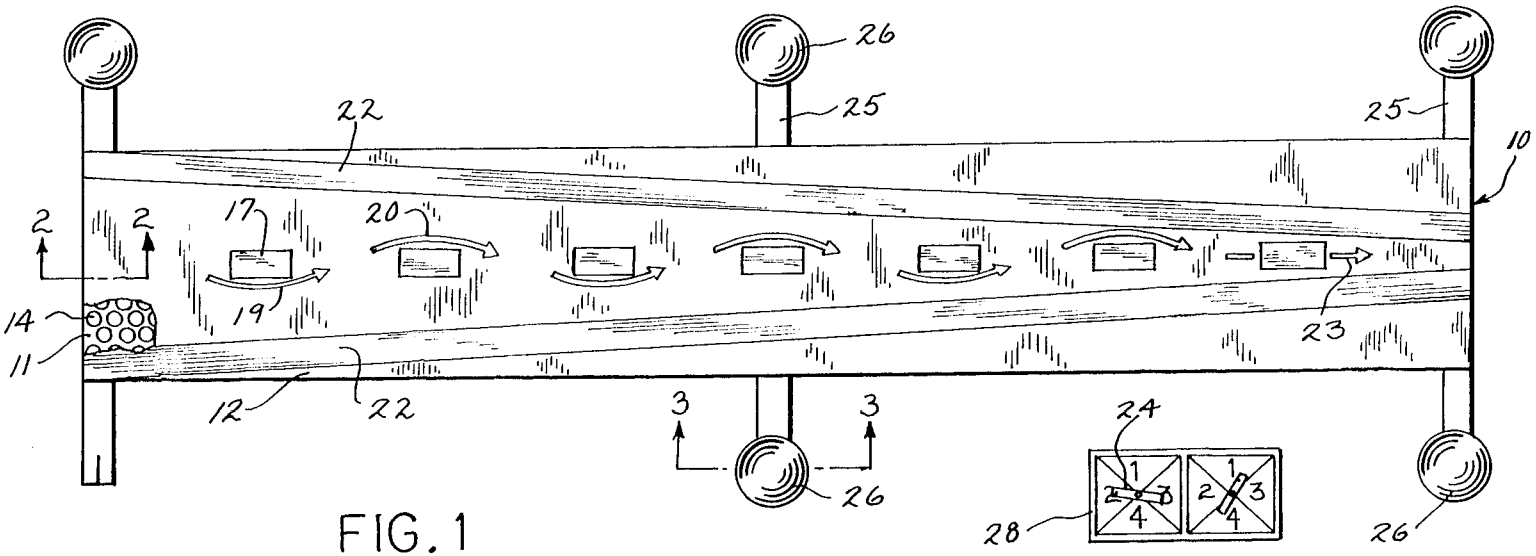
FIG. 1
FIG. 1A
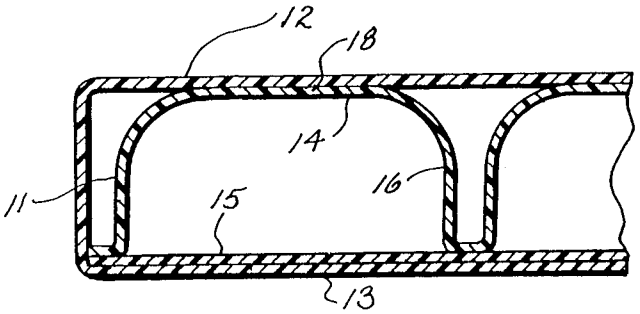
FIG. 2
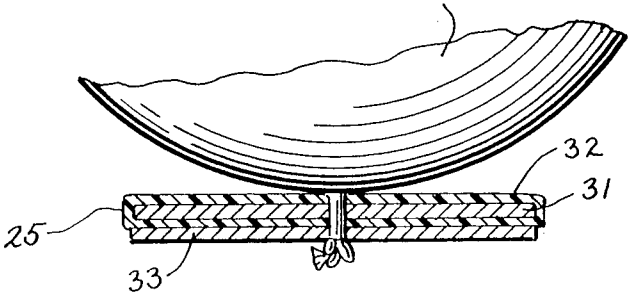
FIG. 3

POPPING SOUND TOY

BACKGROUND OF THE INVENTION

This invention relates to a game or amusement device, and particularly, a game or amusement device which will make a popping sound when impacted by various means of force such as a foot, a hand or a vehicle device such as a skateboard or a bicycle.

It is known in the prior art to utilize a projectile to engage a balloon target so as to effect the breaking of the balloon. This is described in U.S. Pat. No. 4,155,552. In U.S. Pat. No. 2,247,634 a dart game is utilized in conjunction with exploding balloons. The prior art does not provide a game or amusement device wherein a bubble type plastic can be incorporated into the game so as to make a popping sound when forceably contacted. While exploding balloon type games or amusement devices are known, it is not known to utilize exploding bubbles of plastic in various embodiments wherein a variety of games or amusement devices can be constructed.

It is an advantage of the present invention to provide an improved game or amusement device.

It is another advantage of this invention to provide a game device wherein a popping sound is generated by physically contacting the device in conjunction with the playing of a game.

It is yet another advantage of this invention to provide a game device wherein various graphic materials can be incorporated over a bubble type plastic sheet for use in the device wherein the bubbles can be fractured to make a popping sound.

It is still another advantage of this invention to provide a game or amusement device which is especially adapted for playing by small children as well as the handicapped including those in wheel chairs, using crutches and blind children.

Still another advantage of the invention is to provide a game device which provides a test for agility yet at the same time amusement.

Yet another advantage of the invention is to provide a device of the foregoing type which is easily constructed and thus inexpensive.

SUMMARY OF THE INVENTION

The foregoing advantages are accomplished and the disadvantages of the prior art are overcome by the present game or amusement device which is adapted to making a popping sound when compressed in certain areas. A series of bubble like pocket members are constructed so that when they are compressed by at least a child's body weight will break, making a popping sound. The series of bubble like pocket members are arranged in a manner that they can be supported on a supporting surface. Indicia is placed over the pocket members to indicate a predetermined pattern for breaking the pocket members.

In one embodiment, a plastic sheet of bubbles is covered with graphic indicia indicating obstacles. Direction arrows are placed around the obstacles to indicate to the rider of a small bicycle, tricycle, or skateboard to avoid the obstacles yet making a popping sound on the bubble sheet as one rides over the bubble sheet. Road type markings are also indicated so as to provide a constricting type pathway to make it more of a challenge for the rider to avoid the obstacles. A spinner type dial unit is provided which will have two dials, one for indicating the order of play and the other to indicate the number of attempts which the rider is entitled to to break the plastic bubbles. Anchor type straps are employed in conjunction with the bubble sheet in order to be able to secure it to a solid background such as a driveway or a hardwood or tile floor.

In another embodiment, graphic material in the form of bugs are placed over the bubble sheet and a game is played in conjunction with spinner dials with each contestant popping as many plastic pockets under the bugs as indicated by the dials. The object of the game is that the first person to break all the bubbles in its designated area wins the game.

In still another embodiment, a pillow is formed in conjunction with the bubble sheet material and includes handles for one to sit on the pillow and bounce it against a hard surface in order to pop the plastic bubbles.

In yet another embodiment, a game similar to hop scotch is utilized with the indicia for the hop scotch game being placed over the bubble sheet. The usual toss indicator is also employed.

In yet another embodiment, a firecracker display is placed over the bubble sheet and the user can indiscriminately pop the bubbles in any manner he sees fit such as riding over it with a previously described vehicle or jumping on it for the purpose of popping the plastic bubbles.

The foregoing and other advantages of the invention will appear from the following description. In the description, reference is made to the accompanying drawings which form a part thereof, and in which there is shown, by way of illustration preferred embodiments of the invention. Such embodiments do not necessarily represent a full scope of the invention, however, and reference is made therefore or to the claims herein in interpreting the scope of the invention.

BRIEF DESCRIPTION OF THE DRAWINGS

FIG. 1 is a top plan view of a game device which employs the present invention.

FIG. 1A is a top plan view of spinner dials for use in conjunction with the game device shown in FIG. 1.

FIG. 2 is a sectional view taken along line 2—2 of FIG. 1.

FIG. 3 is a sectional view taken along line 3—3 of FIG. 1.

DESCRIPTION OF THE PREFERRED EMBODIMENT

Figure 4:
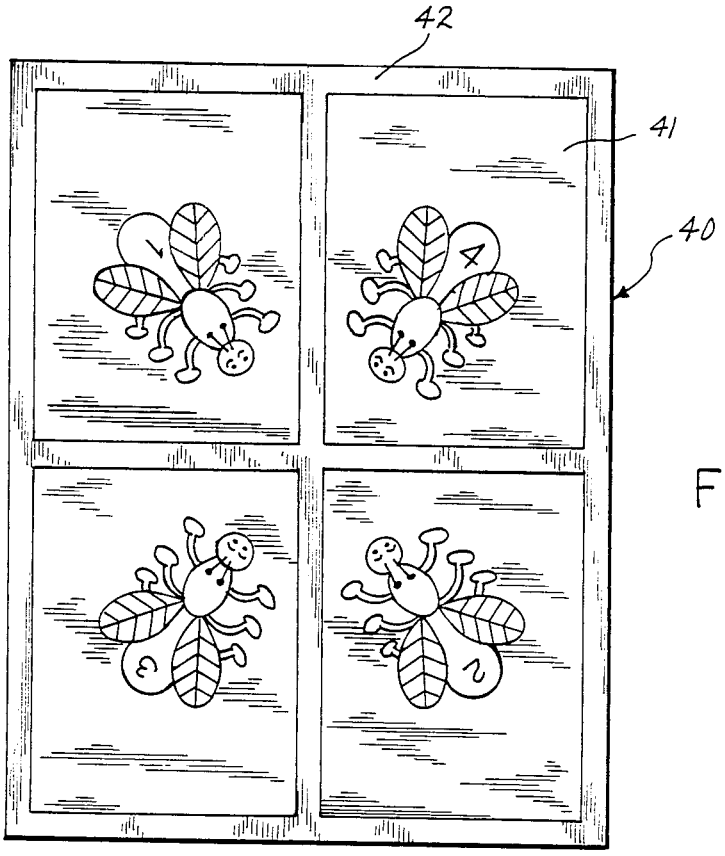
FIG. 4 is a top plan view of another embodiment.

Referring to FIGS. 1–3 of the drawings, the first embodiment generally shown at 10 is called "Action Alley". It includes a sheet of plastic bubbles 11, the type which can be easily fractured by squeezing between the forefinger and the thumb to make a popping sound. In this case it is intended to be contacted by a child riding a small vehicle, such as a bicycle, tricycle, scooter or skateboard over it. A covering 12 is placed over the bubble sheet 11. The covering 12 in this instance is a black plastic sheet material which is 4 mils thick. As shown in FIG. 2, covering 12 is wrapped around a portion of the bubble sheet 11 to provide an extension 13. Each bubble 14 is composed of a dome portion 18 and a connecting portion 16 adhered to a base portion 15. A graphic obstacle 17 in the form of plastic cloth tape is placed over the covering 12 and direction arrows such as 19 and 20 are placed therearound. A final arrow 23 is also indicated. Road markings 22 are shown in a converging manner to make the game more of a challenge. Extending from under the bubble sheet 11, and preferably attached to the extension 13 are the anchors 25. As best seen in FIG. 3, these are composed of cardboard strips 31 surrounded by plastic tape 32, under which is positioned double faced carpet tape 33. This would be for the purpose of securing the device 10 to a supporting surface, such as a driveway, hardwood or tile floor.

The Action Alley device 10 is played by each player spinning one of the spinner dials 28 with the spinner 29. One of the dials will establish the order of the players to be used throughout the game. The player is allowed as many passes as the other spinner dial indicates. The player can hop, run, jump, use a skateboard, scooter or similar type vehicle and proceed from the wider end 21 of the course to the narrower one 24. The players continue to take turns as indicated from the initial spinning of the dial until there are no more cracks or pops left in the roadway. The player who breaks the last remaining bubbles wins. It will be recognized that in order to add an additional attraction to the game balloons such as 26, can be secured through the anchors 25. These are not essential and can be eliminated if desired.

Referring to embodiment generally 40, as shown in FIG. 4, this is referred to as "Bang the Bugs". As indicated in this Figure there is a graphic covering 41, which will be placed over the bubble sheet such as 11 in FIG. 1. The covering 41 in this instance is black and is similar to covering 12 except it is 2 mils thick. In this case there are four bugs 43 indicated in four sections delineated by the yellow plastic tape 42. This particular game would be played by the player spinning one of the dials 28 as previously indicated with the first dial indicating the order of the players, and the second designating number of engagements which the player can make with the bubble sheet by engagement with a fist. The player who breaks all of the bubbles in a black area bordered by the yellow borders 42 is the winner. This is easily determined by comparing with the unbroken bubbles under the border tape 42. Alternatively, the bubbles under the borders 42 could be pre-broken as a reference of comparison.

Figure 5:
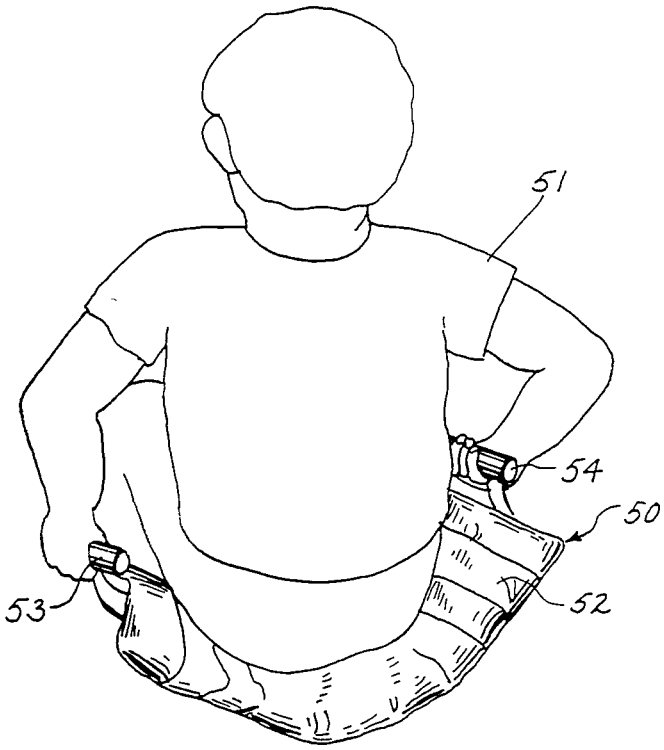
FIG. 5 is a perspective view of still another embodiment.

Referring to FIG. 5 there is shown another embodiment called the "Pillow Popper" and designated generally by the numeral 50. It also will have a covering 52 which will be placed over a bubble sheet similar to 11. In this instance, handles 53 will extend from the covering materials so as to be easily grasped by a child 51. The child by sitting on the cushion, grasping the handles and bouncing up and down will hear the popping sound. This will aid in developing coordination and balance. This particular embodiment lends itself to various modifications in that if desired, the covering material 52 can be formed similar to a pillowcase with the graphic material imposed thereon. A bubble sheet 11 can then be removed when it is exhausted and a new bubble sheet inserted.

Figure 6:
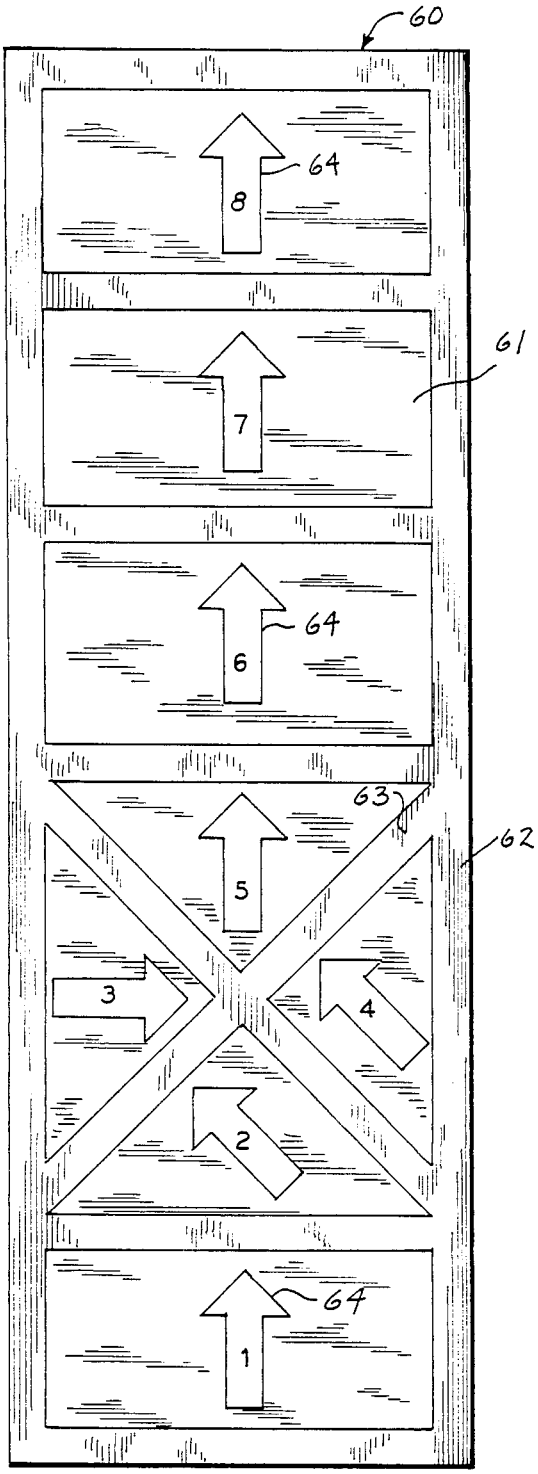
FIGS. 6 and 7 are top plan views of yet other embodiments.

Turning to FIG. 6, this particular embodiment generally 60 is referred to as "Pop Scotch". It would be played in a manner similar to hop scotch with the covering 61 placed over a bubble sheet similar to 11. Embodiment 60 will have the graphic arrows 64, indicating the order of hopping as well as the direction. Numeral 62 and 63 indicate plastic cloth tape which delineate the various areas into which the person is designated to hop. As in the previous embodiment 10 when one does hop in the indicated areas with the arrows, a popping sound will be made. Not shown in this game is a toss indicator similar to the hop scotch game which preferably could be a small washer of approximately 1-½" in diameter, and covered with graphics. In this instance the popping sound is an added dimension to the game with the object being the same as with a hop scotch game.

Figure 7:
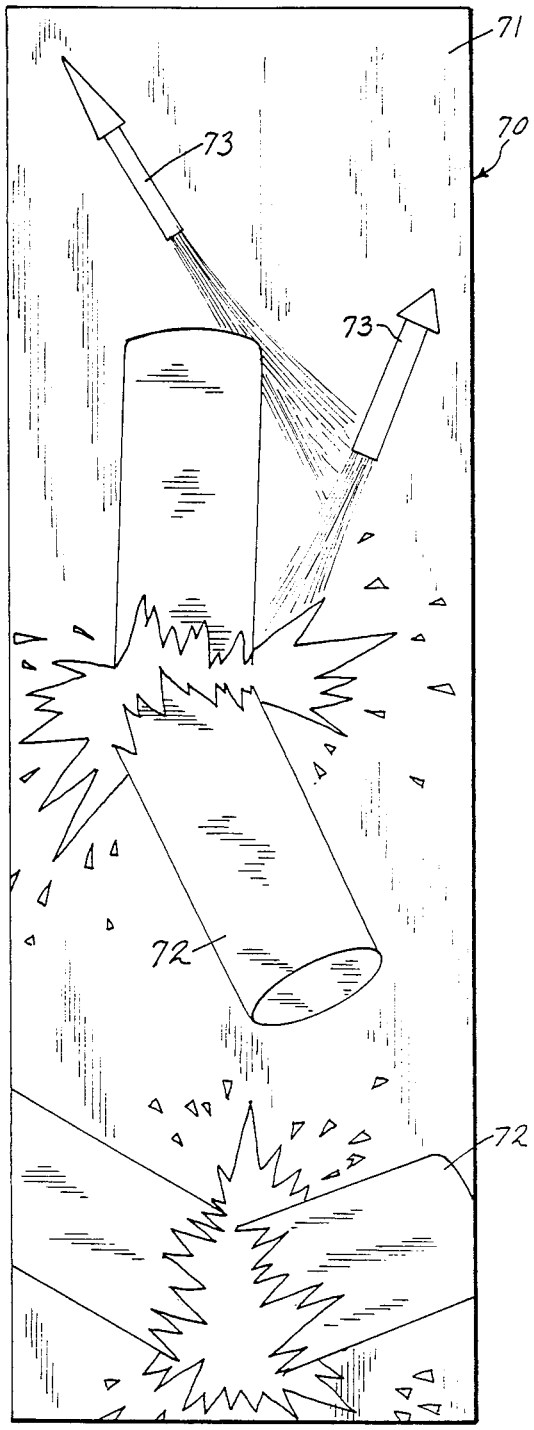

Referring to embodiment generally 70 in FIG. 7, this as in the previous ones has a graphic covering 71, also placed over a bubble sheet such as 11. Pictorial subject matter is shown by the firecrackers as represented by the numeral 72, and rockets as represented by the numeral 73. This is to simulate a 4th of July display and the colors could be red, white and blue. In this instance the object is to experience a sensation of popping the plastic bubbles in the bubble sheet 11 in conjunction with seeing the firecrackers, and the rockets on the graphic covering 71. The bubbles can be exploded either by running over, jumping upon or riding a vehicle such as previously indicated.

In the previous embodiments, the preferred bubble sheet 11 is sold under the trade name Aircap 120. The size of the dome portion 18 is preferably 1½ inches in diameter. The bubble 14, with the dome portion 18 and connection portion 16, are approximately 3 mils thick. A covering such as 12, 41, 52, 61 and 71 is a black polyethylene sheet material and can range from 2–4 mils with 2–3 being preferred. The graphics such as would include the obstacles 17, the direction arrows 19, the road markings 22, the arrows 23, the bugs 43, as well as the tapes 22, 42, 62 and 63 and the arrows 19, 23 and 64, are all composed from a plastic cloth tape. If desired, the plastic cloth tape could be replaced by printing directly onto the covering 12. Alternatively the indicia could be placed directly on the dome portions 18 of the bubble sheet 11 and still have the same popping effect in conjunction with playing the various games.

It should be apparent to those skilled in the art that a number of other variations can be made from the preferred embodiments without departing from the spirit of the invention. For example, the arrangement and shape of the bubbles 14, in the bubble sheet 11, can be of various configurations and thicknesses. The bubble sheet can be of various sizes and can be supported on curved as well as flat supporting surfaces. All that is required is that a popping sound be made when contacted either by a force from a hand, foot or a small vehicle. Preferably this force will be similar to that exerted by a small child. It is also obvious that various other graphic materials and various colors can be utilized in conjunction with the covering for the bubble sheet. For example, with respect to the 4th of July display 70, the graphics could be changed to depict noisemakers such as typically used at New Year's Eve. On all of the embodiments, fluorescent materials could be employed for nighttime use. While it is preferred and some of the embodiments do have the anchors such as strips 25, these could be eliminated. In the instance of embodiment 50, it was stated that a pillowcase concept could be employed for replacement of the bubble sheet. This would apply to all of the other embodiments disclosed herein.

I claim:

1. A game or amusement device adapted to making a popping sound when compressed in certain areas comprising:

a series of bubble like pocket members constructed so that when they are compressed by at least a child's body weight will break and make a popping sound;

said series of bubble like pocket members arranged in a manner that they can be supported on a supporting surface; and indicia placed over said pocket members to indicate to a player a predetermined pattern for breaking the pocket members.

2. The device of claim 1 wherein said indicia comprises markings delineating a roadway composed of obstacles with directional arrows.

3. The device of claim 2 wherein said roadway is defined by road markings delineating a constricting type pathway.

4. The device of claim 3 wherein said road markings are composed of a plastic cloth tape.

5. The device of claim 1 wherein said indicia comprises a pictorial representation of at least two bugs.

6. The device of claim 1 wherein said indicia is in the format of a hop scotch game.

7. The device as defined in claim 6 wherein said indicia includes directional arrows as well as tape type delineations.

* * * * *